United States Patent [19]

Martschinke

[11] 4,188,840

[45] Feb. 19, 1980

[54] CONDUCTOR CABLE UNTWISTING TOOL

[75] Inventor: Charles E. Martschinke, Bolingbrook, Ill.

[73] Assignee: Bell Telephone Laboratories, Incorporated, Murray Hill, N.J.

[21] Appl. No.: 908,283

[22] Filed: May 22, 1978

[51] Int. Cl.[2] ..... B25B 9/00

[52] U.S. Cl. ..... 81/3 R; 140/118; 140/149

[58] Field of Search ..... 81/1 R, 3 R, 3 J; 140/93.6, 118, 123, 149

[56] References Cited

U.S. PATENT DOCUMENTS

| | | | |
|---|---|---|---|
| 1,211,020 | 1/1917 | Welsby | 81/3 R |
| 3,163,187 | 12/1964 | MacIntosh | 140/93.6 |
| 3,168,118 | 2/1965 | Holman | 140/149 X |
| 3,186,262 | 6/1965 | Parstorfer | 81/3 R |
| 3,312,128 | 4/1967 | Wasson | 81/3 R |

*Primary Examiner*—James G. Smith

*Attorney, Agent, or Firm*—William H. Kamstra

[57] ABSTRACT

A tool for untwisting the conductors of a twisted conductor cable comprising a rod of electrically insulating material having a tapered end and a channel bored into its tapered end initially along its longitudinal axis. The channel is angled away from the latter axis to emerge at the surface of the rod at the tapered end and is dimensioned to receive the diameter of a conductor which is inserted into the channel at the end of the rod. The tapered end facilitates the initial separation of the conductors and the tool is operated by rotation between thumb and forefinger until the desired length of conductor end segment is reached.

4 Claims, 3 Drawing Figures

CONDUCTOR CABLE UNTWISTING TOOL

TECHNICAL FIELD

This invention relates to devices and apparatus for preparing electrical cables for circuit interconnections and particularly to such devices and apparatus adapted for untwisting the ends of the individual conductors of twisted electrical cables.

BACKGROUND ART

Devices and apparatus for facilitating the handling and preparation of electrical cables and conductors for circuit interconnection have long been known in the art and a few have become standard items of an electrical craftsman's tool kit. Insulation stripping tools and tools for gripping conductors, to name two for example, have become virtually indispensable in the preparation of electrical wiring for installation. Although not specifically designed for electrical wiring, one tool of the latter character is described, for example, in the patent of L. W. Wasson, No. 3,312,128 issued Apr. 4, 1967, and comprises a pencil-like device sharply tapered at one end and bored along its longitudinal axis to accommodate the diameter of a wire to be gripped. After insertion of the wire for the length of the tool, a lever mounted in its body is manually forced and held against the wire to permit a firm grasp of the wire for its subsequent handling. So too, devices for twisting individual conductors into cables date almost to the beginning of the art. One such device is described, for example, in the patent of P. A. Welsby, U.S. Pat. No. 1,211,020, issued Jan. 2, 1917. By whatever method the conductors of a multiconductor cable are twisted together—in present day technology such conductors would be tightly machine twisted—suitable lengths must be untwisted before any insulation stripping and other operations can be performed. Heretofore, the untwisting of segments of twisted cable conductors has been manually accomplished taking an obvious toll of the fingers, particularly when large numbers of cables must be untwisted or when relatively heavy gauge conductors are involved. As a result, a common-place untwisting method is simply to grasp the cable or conductor pair between the jaws of a pliers or similar tool and by forcibly drawing the conductor therebetween, cause them to unwind. Because of the high grasping and withdrawal forces required to thus untwist the conductors, damage to both insulation and conductors is frequently unavoidable. It is the problem of untwisting the conductors of, say, a twisted conductor pair without damaging the conductors in the process with which the device of this invention is concerned.

DISCLOSURE OF THE INVENTION

The foregoing problem is advantageously solved and a technical advance is achieved in accordance with this invention by a twisted cable conductor untwisting tool comprising a pencil-like rod of an electrically insulating material tapered at one end and bored along its longitudinal axis a short distance at its tapered end. A similarly dimensioned bore is provided at the tapered end at an angle to the longitudinal axis beginning at the end of the first bore and emerging on the tapered surface. The angled channel thus formed at the end of the tool is dimensioned to accommodate the diameter of the cable conductors with which the tool is to be used. The tool is simply operated by manually inserting a short length of the end of a cable conductor into the tool end until it emerges at the side, the tapered end acting initially to pry apart and separate the conductor from its adjoining conductor. The tool is then rotated between thumb and forefinger with a continuing loading pressure in a rotational direction opposite to the winding direction of the cable until the desired conductor end segment is reached.

BRIEF DESCRIPTION OF THE DRAWING

The organization and operation of an untwisting tool according to the principles of this invention will be better understood from a consideration of the detail description of one specific illustrative embodiment thereof which follows when taken in conjunction with the accompanying drawing in which.

DETAILED DESCRIPTION

Figure 1:
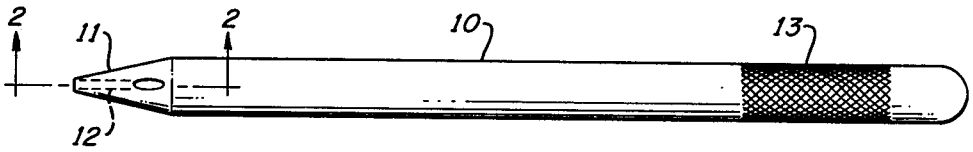
FIG. 1 depicts in top longitudinal view one illustrative cable conductor untwisting tool according to this invention.
Figure 2:
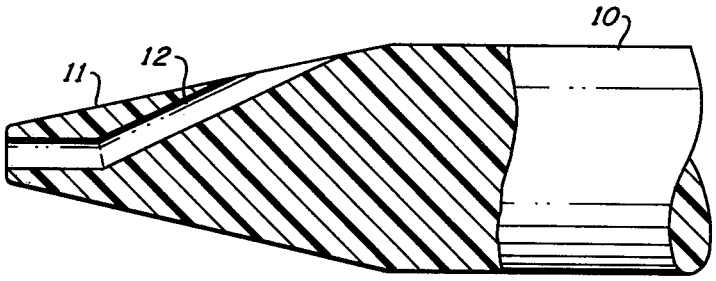
FIG. 2 depicts a portion of the tool of FIG. 1 in an enlarged section view taken along the line 2—2.

One specific illustrative conductor untwisting tool according to this invention is shown in FIG. 1 which comprises a pencil-like rod 10 having a taper 11 at one end. At tapered end 11 the tool is bored along its longitudinal axis for a short distance to meet a similarly dimensioned bore which begins on the tapered surface and runs at an angle to the longitudinal axis to form channel 12. The partially angled channel thus formed is better seen in the enlarged sectional view of FIG. 2 and is dimensioned to freely receive the diameter of the cable conductors with which the tool may be employed. Rod 10, which may be formed of any suitable electrically insulating material such as wood or plastic, may be of a length as determined by the convenience of handling by thumb and forefinger and may be knurled for a portion 13 of its length for this purpose.

Figure 3:
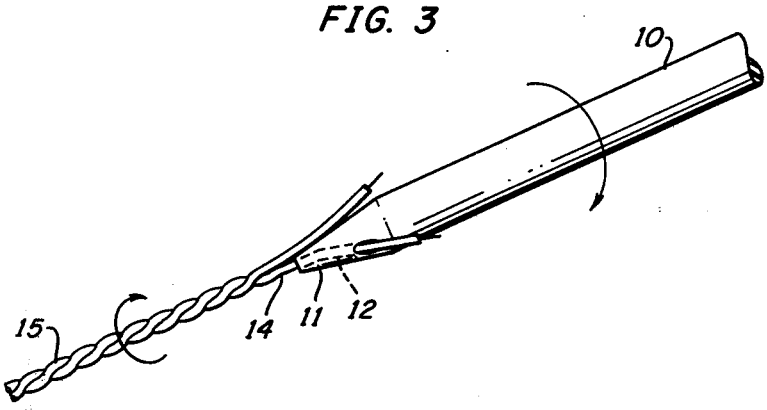
FIG. 3 depicts the manner of employing the tool of FIGS. 1 and 2 to untwist a conductor of a twisted conductor pair cable.

The tool of FIG. 1 is simply operated by inserting a short length of the end of a cable conductor in the end opening as depicted in FIG. 3. One conductor 14 there shown of a cable pair 15, twisted in the direction indicated, is inserted in channel 12, the tapered end serving initially to separate the conductors. Rod 10 is then rotated in a direction as indicated opposite to that of the twist of the cable by thumb and forefinger while a slight thrust toward the cable is maintained until the desired segment length of conductor 14 is untwisted. Rod 10 is then withdrawn and, for a twisted pair, both conductors are now free for further preparation and handling unmarred nor damaged by the untwisting operation. An untwisting tool according by this invention advantageously is simply and cheaply manufacturable by extrusion, for example, if plastic; is quickly and easily used; and occupies little storage and carrying space.

What has been described is considered to be one specific illustrative untwisting tool according to this invention and it is to be understood that other arrangements may be devised by one skilled in the art and without departing from the scope of the invention as defined only by the accompanying claims.

I claim:

1. A tool for untwisting the conductors of a twisted conductor cable comprising an elongated rod having a taper at one end, said rod being bored at said tapered end for a short distance along its longitudinal axis to present a first opening and a portion of a conductor channel, said rod being bored at an angle to said axis to present a second opening on the surface of said tapered end and a completing portion of a conductor channel, said channel being dimensioned to receive the diameter of a conductor of said cable.

2. A tool for untwisting the conductors of a twisted conductor cable comprising a rod having a tapered end and a channel formed therethrough, said channel beginning at an opening at the center of said rod at said tapered end and emerging at an opening on the outer surface of said rod at said tapered end, said channel being dimensioned to receive the diameter of a conductor of said cable.

3. A tool according to claim 2, said rod being formed of an electrically insulating material.

4. A tool for untwisting the conductors of a twisted conductor cable comprising an elongated rod having a tapered end and a channel bored substantially along its longitudinal axis, characterized in that said channel is dimensioned to receive the diameter of a conductor of said cable and in that said channel extends only a short distance in from said tapered end and in that said channel continues at an angle to said axis to emerge on said rod at said tapered end.

* * * * *